US008511046B2

(12) United States Patent
Felgenhauer

(10) Patent No.: US 8,511,046 B2
(45) Date of Patent: Aug. 20, 2013

(54) VACUUM DEVICE FOR PERISHABLE FOOD ITEMS

(76) Inventor: Craig Felgenhauer, Oak Forest, IL (US)

( * ) Notice: Subject to any disclaimer, the term of this patent is extended or adjusted under 35 U.S.C. 154(b) by 322 days.

(21) Appl. No.: 12/876,355

(22) Filed: Sep. 7, 2010

(65) Prior Publication Data

US 2012/0055117 A1 Mar. 8, 2012

(51) Int. Cl.
*B65B 31/06* (2006.01)

(52) U.S. Cl.
USPC ..... 53/432; 53/510; 53/111 R

(58) Field of Classification Search
USPC ..... 53/432, 434, 510, 512, 111 R
See application file for complete search history.

(56) References Cited

U.S. PATENT DOCUMENTS

| | | | | |
|---|---|---|---|---|
| 3,628,576 | A * | 12/1971 | Owen | 141/95 |
| 3,796,020 | A * | 3/1974 | Anderson et al. | 53/512 |
| 3,968,620 | A * | 7/1976 | Keltner | 53/434 |
| 5,215,445 | A * | 6/1993 | Chen | 417/313 |
| 5,287,680 | A * | 2/1994 | Lau | 53/512 |
| 5,873,217 | A * | 2/1999 | Smith | 53/434 |
| 7,086,211 | B2 * | 8/2006 | Bassett et al. | 53/434 |
| 7,197,860 | B2 * | 4/2007 | Hughes et al. | 53/510 |
| 7,284,361 | B2 * | 10/2007 | Lau | 53/512 |
| 7,308,785 | B2 * | 12/2007 | Bassett et al. | 53/512 |
| 7,395,755 | B1 * | 7/2008 | Deese | 100/35 |
| 7,870,708 | B2 * | 1/2011 | Borchardt et al. | 53/510 |
| 2005/0039421 | A1 * | 2/2005 | Cheung | 53/510 |
| 2005/0076616 | A1 * | 4/2005 | Bassett et al. | 53/432 |
| 2006/0236658 | A1 * | 10/2006 | Bassett et al. | 53/434 |
| 2006/0248861 | A1 * | 11/2006 | Cheung | 53/510 |
| 2006/0260280 | A1 * | 11/2006 | Jones | 53/434 |
| 2008/0135126 | A1 * | 6/2008 | Lemme | 141/8 |

* cited by examiner

*Primary Examiner* — Hemant M Desai
(74) *Attorney, Agent, or Firm* — Valauskas Corder LLC

(57) ABSTRACT

A vacuum device for removal of air from a flexible package storing a perishable food item includes a motor and fan blade assembly having a first air channel and fan blade housing. The fan blade housing encloses at least a portion of a motor and fan blade forming part of the motor and fan blade assembly. The vacuum device also has a nozzle assembly electrically connected to the motor and fan blade assembly. The nozzle assembly is provided with a second air channel in fluid communication with the first air channel. Air in an external environment flows through the second air channel and into to the first air channel upon actuation of the nozzle assembly to a closed position, which energizes the motor and rotates the fan blade connected to the motor to draw air from the external environment into the device.

20 Claims, 6 Drawing Sheets

VACUUM DEVICE FOR PERISHABLE FOOD ITEMS

FIELD OF THE INVENTION

The present invention generally relates to a vacuum device and method, and more particularly to a vacuum device and method by which a perishable food item may be preserved for an extended period of time.

BACKGROUND OF THE INVENTION

Perishable food items are typically prepared through the application of one or more food preparation techniques or cooking processes to prepare the food items. In such a process, various preservatives are often added to extend the shelf life of such food items. In other instances, such food items are stored in packages that have vacuum-like environments to limit exposure to the ambient air.

Because of the organic origin of some or all of its components, the freshness of a food item typically degrades in quality with time. A food item typically must be stored in some way to permit it to be consumed as intended. To slow the degradation process, and in order to maintain freshness, food items are typically placed in closed or sealed containers, and/or stored or maintained to lessen the exposure of the food items to the ambient air. While it is often possible to limit the exposure of food items to the ambient air at the time of storing a food item in a package, conditions do not permit the use of such protective storage once the package is opened and exposed to the ambient air. In some instances, flexible packages are provided to store food items that can be deformed and resealed to decrease the amount of air in such packages. Although existing flexible packages can readily be resealed, such packages contain an excessive amount of air within the resealed package. As a result, food items stored in the resealed flexible packages are quickly degraded resulting in consumers being prevented from ingesting the food item due to spoilage of the food item.

It is clear that there is a demand for a device and method that extends the shelf life of a food item that has been exposed to the ambient air upon an opening of a flexible package storing the food item. The present invention satisfies these various demands.

SUMMARY OF THE INVENTION

The device of the present invention includes a motor and fan blade assembly for generating a vacuum-type air flow to deflate a flexible package. For purposes of this application, a flexible package can be any type of deformable packaging that is used to store perishable food items, such as zip-lock type bags, plastic bags, zippered luncheon meat bags, bread storage bags, etc. Air is vacuumed from the flexible package and passes through and exits the device through one or more air vents. Since air is generally unable to return to the flexible package by operation of the device, the deformed flexible package has substantially less air contained within the flexible package as compared to packages that are sealed by manual deflation and sealing of the package.

In one embodiment, a motor and fan blade assembly may remove air from a flexible package upon operation of the motor which causes rotation of a fan blade. The motor and fan blade assembly may include a first air channel that facilitates exiting of an air flow from the vacuum device. The device may also have a fan blade housing that encloses at least a portion of the motor and fan blade assembly, and a nozzle assembly.

The nozzle assembly may be electrically connected to the motor and fan blade assembly so as to act as a switch that can be used to operate the device.

The nozzle assembly may also have a second air channel in fluid communication with the first air channel, such that when a portion of a flexible package is placed around a lower end of the nozzle assembly and the motor is turned on, then the air in an external environment (e.g., within the flexible packaging) flows through the second air channel and into to the first air channel. The motor may be configured to be turned on and operated upon actuation of the nozzle assembly to a closed position. The closed position can be when an electrical circuit connected to the motor and a power source is closed causing an electric current to pass through the motor.

In one embodiment, a stand-alone vacuum device is configured to remove air from within a flexible package. The stand-alone vacuum device is independently positioned on a surface, such as a kitchen countertop. The device includes a base for placement of the device on the kitchen countertop, or other flat surface selected by a user, and a motor connected to the base. A fan blade is connected to the motor and creates an air flow when rotated by the motor. A housing having one or more air vents surrounds at least a portion of the motor and fan blade assembly. The housing may be designed to have a frictional fit.

The present embodiment of the stand-alone vacuum device also has a nozzle assembly connected to the motor and fan blade assembly. The nozzle assembly includes an air passage in fluid communication with the one or more air vents. Upon operation of the motor and fan blade assembly, air enters through the nozzle assembly and exits through the air vents. In this manner, a flexible package can be placed such that its open part substantially surrounds the nozzle and then the device may be operated to remove air from within the flexible package. Thus, the flexible package can deform and provide at least a partial vacuum seal for food items stored within the flexible package.

In yet another embodiment of the present invention, a method for preserving perishable consumer goods stored in a sealed flexible package that has been unsealed includes a step of positioning an open part of the unsealed flexible package around a first end of a nozzle having an air passage extending from the first end to a second end of the nozzle. The method also has steps of generating an air flow through the air passage such that substantially any air within the unsealed flexible package passes through the air passage and exits into the ambient environment, and removing the unsealed flexible package from the first end of the nozzle upon a substantial portion of the air within the unsealed flexible package exiting from the unsealed flexible package. Upon removal of the package from the first end of the nozzle, the method may have a further step of resealing the unsealed flexible package so as to prevent air from entering the flexible package and causing degradation of food items.

BRIEF DESCRIPTION OF THE DRAWINGS

The preferred embodiments of the invention will be described in conjunction with the appended drawings provided to illustrate and not to the limit the invention, where like designations denoted like elements, and in which.

DETAILED DESCRIPTION OF PREFERRED EMBODIMENTS

Figure 1:
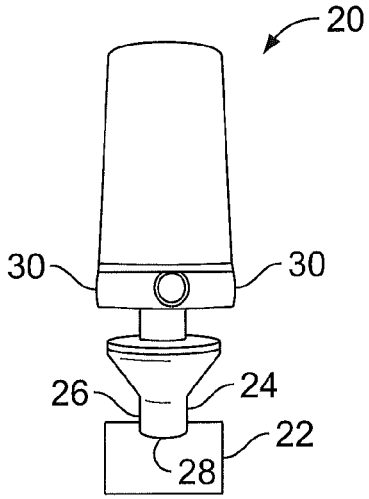
FIG. 1 is a perspective view of one embodiment of a vacuum device for perishable consumer food items according to the present invention with a flexible package in contact therewith.

FIG. 1 is a perspective view of a vacuum device 20 for perishable consumer food items according to a first preferred embodiment of the present invention with a flexible package 22 in contact therewith. As shown in FIG. 1, the vacuum device 20 has an air inlet end 24 for receiving an open part 26 of the flexible package 22. For purposes of this invention, a vacuum device refers to a device that draws air into the device at one part of the device and expels air from the device through another part of the device.

In the embodiments described below, the flexible package 22 may be any type of consumer food item container that is collapsible, such as a plastic bread bag. In use, a food item (e.g., bread) is placed in the bread bag and has air removed therefrom as the device draws air from the open part of the bread bag into an air inlet 28. Generally, a user holds the open part 26 of the bread bag around the air inlet 28 so that air exiting the bread bag enters the vacuum device 20 without air external to the bread bag entering the device. The air entering the vacuum device 20 passes through internal passages of the device and discharges at one or more air vents 30. The open part 26 of the bread bag may be firmly positioned around an air inlet 28 of the vacuum device 20 that draws air into the device such that a partial vacuum is created in the bread bag. The bread bag may then be removed from the device and sealed by a user using known bag closing mechanisms, such as zipper closures, ties, etc. Advantageously, by using the vacuum device 20 to withdraw air from the flexible package 22, it is possible to remove a substantial amount of air (e.g., greater than at least 90% and preferably greater than at least 98%) from the flexible package and improve shelf life of perishable food items stored in the flexible package.

Generally, the vacuum device 20 is configured to provide a sufficient air flow through the device so as to be able to gradually remove air from the open portion 26 of the flexible package 22 that surrounds the air inlet end 24 of the device. The rate of air flow is preferably controlled so as to prevent rapid collapsing of the flexible package 22 and crushing of food items (not shown) contained within the flexible package. One skilled in the art would be aware of restrictions on the air flow and vacuuming capacity of the vacuum device 20 so as to prevent damage to food items during operation of the device.

The vacuum device 20 draws air from the ambient environment near the air input end 24 and passes such air through an internal part of the vacuum device. The air drawn into the vacuum device 20 exits at one or more vents 30 located at a part of the device that is away from the air input end 24.

Figure 2:
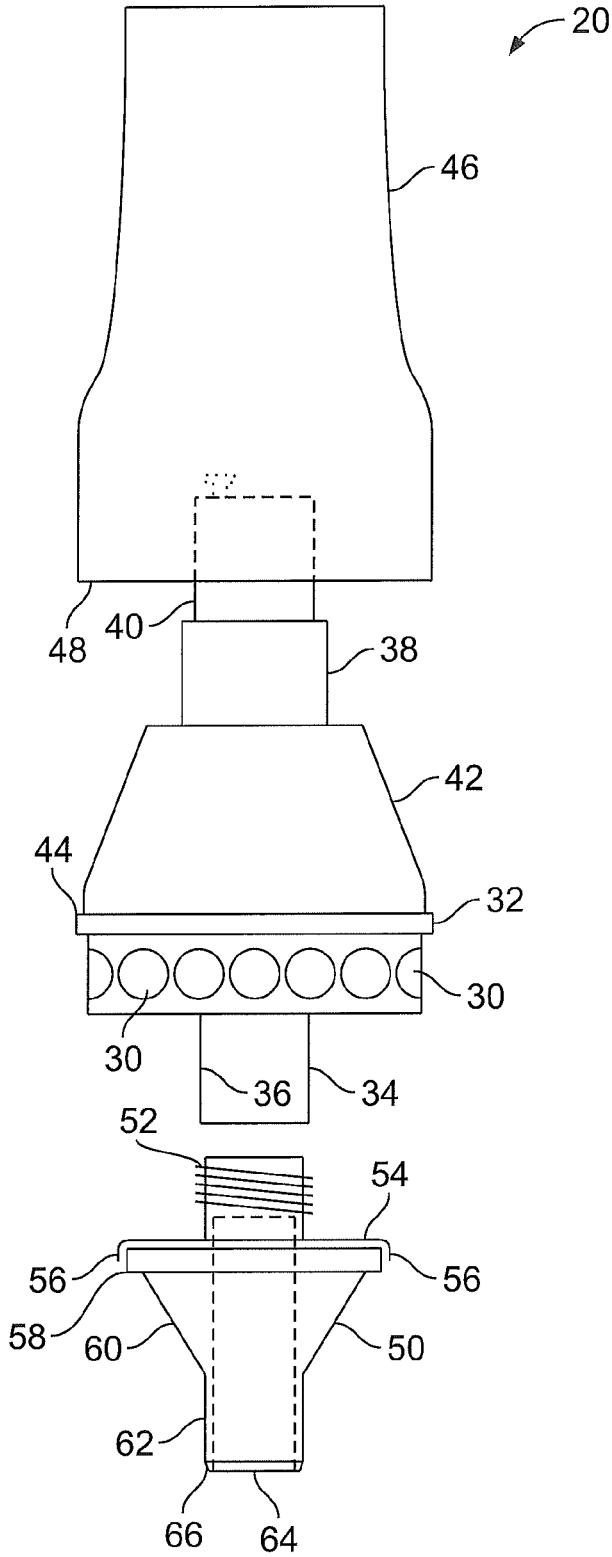
FIG. 2 is an exploded side view of the vacuum device of FIG. 1.

FIG. 2 illustrates an exploded side view of the vacuum device 20 of the first preferred embodiment of the present invention. The vacuum device 20 generally includes three main components. The first component is a motor and fan blade assembly 32 that includes the air vents 30. This component generates the air flow through the vacuum device 20, which creates the partial vacuum in the flexible package 22.

The motor and fan blade assembly 32 has a lower portion 34 provided with internal female threads 36 for engagement with a male threaded component. An upper portion 38 of the motor and fan blade assembly 32 is configured to receive a power supply 40, such as a battery which may be seated within a part of the upper portion. The type of power source or battery strength will depend upon a desired air flow through the vacuum device 20, suction power of the device, etc. as is well known to those skilled in the art.

The motor and fan blade assembly 32 further includes a motor housing 42. The motor housing 42 at least partially encloses a motor and fan (see FIG. 3) of the motor and fan blade assembly 32. The motor housing 42 is sealed to prevent air drawn into the vacuum device 20 at the air inlet 28 from escaping from the device other than through the air outlets 30. The motor housing 42 also provides an annular rim 44, which acts as a stop for the second main component of the vacuum device 20.

The second main component of the vacuum device 20 is a power supply housing 46 that may enclose the power supply 40 and a portion of the motor and fan blade assembly 32. In one preferred embodiment the power supply housing 46 is formed in a conical shape and has a lower annual edge 48 that is configured to engage the annular rim 44 of the motor and fan blade assembly 32 and has a frictional fit with the motor housing 42. Advantageously, a frictional fit facilitates easy removal of the power supply housing 46 and replacement of the power source 40 as needed. The power supply housing 46 can be formed of various materials that provide sufficient rigidity and protection to the power supply 40, and preferably is formed of a plastic material.

The third main component of the motor and fan blade assembly 32 is a nozzle assembly 50. The nozzle assembly 50 has an upper male threaded portion 52 that is threaded into the female threads 36 of the lower portion 34 of the motor and fan blade assembly 32. The male threaded portion 52 connects to an annular member 54. In one embodiment, the male threaded portion 52 is attached to the annular member 54 via an adhesive. However, other attaching methods can be used such as lock and catch mechanisms. Upon threading of the male threaded portion 52 into the female threads 36, the annular member 54 is removably fixed to the motor and fan blade assembly 32.

The annular member 54 has a curved end portion 56 that is configured to receive a funnel housing 58. The funnel housing 58 can be formed of plastic or other rigid materials and includes a conical part 60 that may engage the annular member 54 and a stem part 62. The curved end portion 56 may act as a guide for the conical part 60 when it engages the annular member 54. The stem part 62 is preferably formed in a cylindrical shape to facilitate insertion of a tube member 64 (shown partially in phantom) through the funnel housing 58. The tube member 64 is connected to the motor and fan blade assembly 32.

In one embodiment, the funnel housing 58 is reciprocally moveable along the tube member 64 such that the funnel housing can move towards or away from the motor and fan blade assembly 32. The movement of the funnel housing 58 in a downward direction away from the motor and fan blade assembly 32 can be stopped by an annular flange 66 of the tube member 64. The movement of the funnel housing 58 in an upward direction toward the motor and fan blade assembly 32 may be stopped by contact with the annular member 54. In one embodiment, the funnel housing 58 may rotate about the tube member 64 and can engage the annular member 54.

Figure 3:
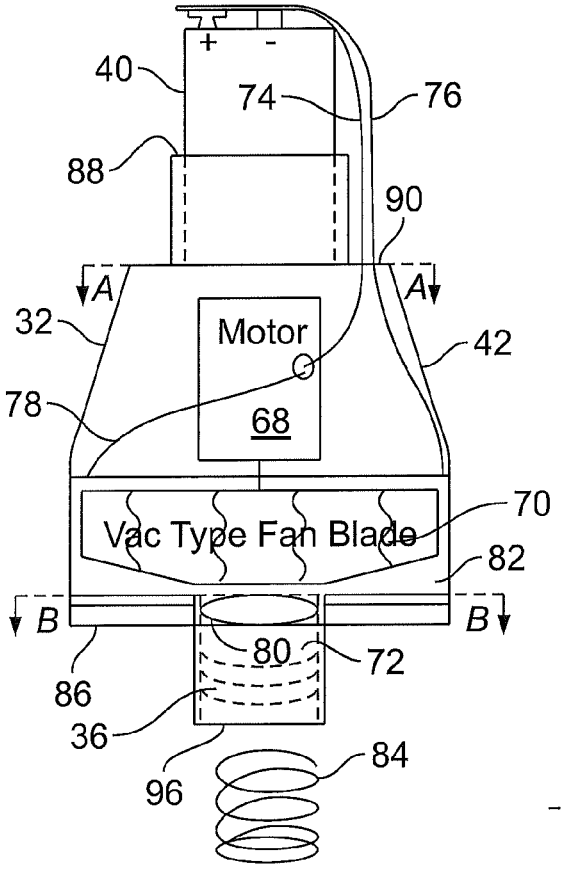
FIG. 3 is a side view of the motor and fan blade assembly of the vacuum device of FIG. 1.

Turning now to FIG. 3, a side view of the motor and fan blade assembly 32 of the vacuum device 20 of FIG. 1 is illustrated. A motor 68 and fan blade 70 are located within the motor housing 42. The fan blade 70 is a vacuum type fan blade that is connected to the motor 68. Upon operation of the motor 68, the fan blade 70 is rotated to generate an air flow into a first air channel 72 which exits via the vents 30. The first air channel 72 is in fluid communication with the vents 30. The motor housing 42 is preferably sealed so that air which enters the motor and fan blade assembly 32 via the first air channel 72 can only pass through the vents 30. However, it is envisioned that the location of the vents 30 on the motor housing 42 can vary depending upon desired design choices as is known to those skilled in the art.

The motor and fan blade assembly 32 further includes a power supply 40. The power supply 40 can be a battery which is seated within a portion of the housing 42. Preferably, the battery is seated by a friction fit within the housing 42, although other methods of attaching the battery such as using clamping mechanisms are possible. A pair of lead lines 74 and 76 is connected to the terminals of the battery. The lead line 74 is also electrically connected to the motor 68. The lead line 78 is electrically connected to the motor 68 and extends to the annular member 54. Preferably, the lead line 78 is positioned within the housing 42 to protect the lead line from damage.

The lead line 74 is electrically isolated from the lead line 76 until the motor 68 is energized by the power supply 40. That is, the nozzle assembly 50 acts as a switch for the vacuum device 20. When the nozzle assembly 50 is positioned to turn on the motor 68, then electric current flows through the motor via the lead lines 74, 76, and 78 and the fan blade 70 is rotated to generate the air flow into the first air channel 72. The lead line 76 connects to a first contact 80 at an arm 82. The arm 82 in one embodiment is configured to hug the inside of the motor housing 42 such that no contact is made with the fan blade 70 when the fan blade is rotated.

The first contact 80 is seated upon a first contact spring 84 which may be inserted at least partially within the first air channel 72. Upon compression of the spring 84, an electrical connection between the spring and power supply 40 occurs. The motor and fan blade assembly 32 also includes a vibration member 86. The vibration member 86 may be annularly shaped so as to cushion the fan blade 70 and motor 68 upon operation of these components and compensate for any torque applied to the fan blade. The vibration member 86 is preferably made of a foam material so as to reduce noise vibration in the vacuum device 20.

Figure 4:
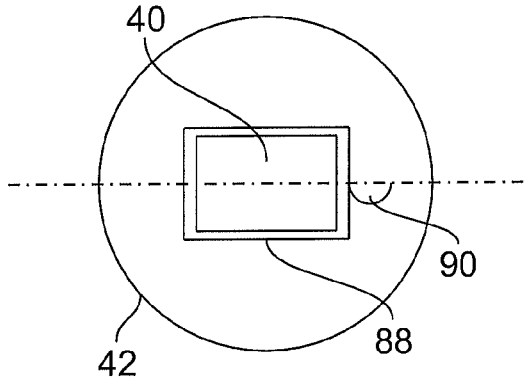
FIG. 4 is a cross-sectional view along line A-A of the motor and fan blade assembly of the vacuum device of FIG. 1.

FIG. 4 shows a cross-sectional view of the motor and fan blade assembly 32 along line A-A of FIG. 3. The motor housing 42 has a rectangular portion 88 that is configured to receive a 9-volt battery. In other embodiments using different power sources, it is understood that the configuration of the portion 88 may vary to house the particular power supply. In this embodiment, the power source 40 is secured to the rectangular portion 88 by a friction fit. The housing 42 further includes an aperture 90 that allows the lead lines 74, 76 to pass through and connect to the power source 40. Preferably, the aperture 90 is located near to the rectangular portion 88 so as to prevent the lead lines 74, 76 from becoming entangled with the power supply housing 46 when the power supply housing is secured to the motor and fan blade assembly 32.

Figure 5:
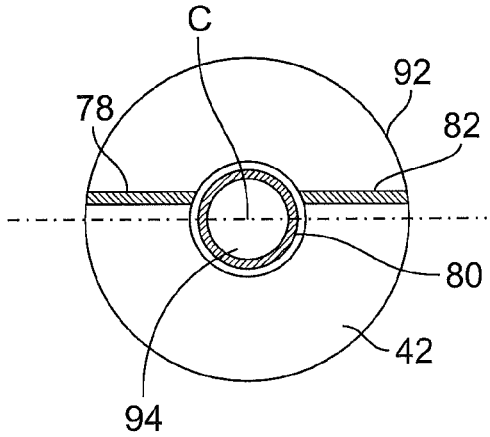
FIG. 5 is a cross-sectional view along line B-B of the motor and fan blade assembly of the vacuum device of FIG. 1.

Turning now to FIG. 5, this figure shows a cross-sectional view of the motor and fan blade assembly 32 along line B-B of FIG. 3. The arm 82 of the first contact 80 extends from a sidewall 92 of the housing 42 toward an aperture 94. The aperture 94 is part of the first air channel 72, and facilitates air flow from an end 96 (see FIG. 3) of the motor and fan blade assembly 32 through the first air channel. FIG. 5 also illustrates an exemplary position of the lead line 78 which extends from the sidewall 92 toward a center C of the housing 42. The first contact 80 is formed radially inward toward the center C of the housing 42 than the lead line 78. This prevents any electrical connection between the lead line 78 and first contact 80. Similarly, the first contact spring 84 is electrically isolated from the lead line 78. This isolation of the lead line 78 from the first contact 80 and first contact spring 84 prevents unwanted operation of the motor 68 and fan blade 70.

Figure 6B:
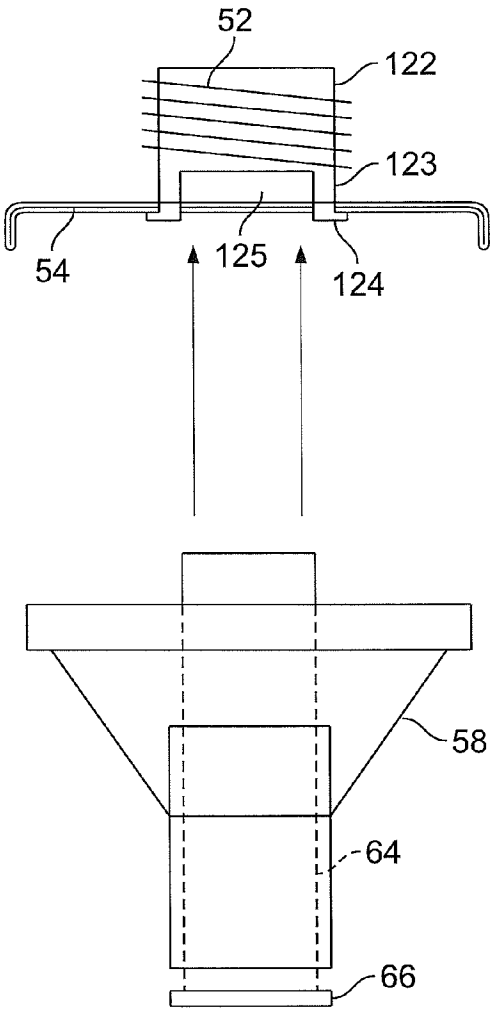
FIG. 6B illustrates the insulating sleeve attachment to the annular member and the tube member of the nozzle assembly of FIG. 6A.
Figure 6A:
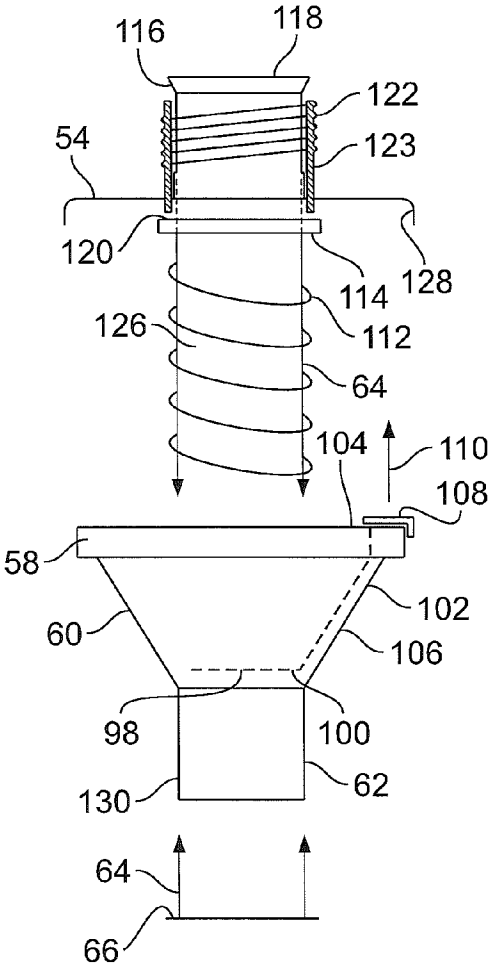
FIG. 6A is a side view of the nozzle assembly of the vacuum device of FIG. 1.

A side view of the nozzle assembly 50 of the vacuum device 20 of FIG. 1 is illustrated in FIG. 6A. The nozzle assembly 50 has an interior portion of the funnel housing 58 within the conical part 60 configured to seat a second contact 98. The second contact 98 has an annular part 100 that is seated within the conical part 60 and an arm 102 that extends to a rim 104 of the funnel housing 58. The arm 102 is preferably configured to extend around the rim 104 and contact a portion of an outer surface 106 of the funnel housing 58. In this arrangement, the arm 102 has a planar portion 108 that can readily contact the annular member 54 upon movement of the funnel housing 58 in the direction of the arrow 110.

The nozzle assembly 50 also has a second contact spring 112 electrically connected to and seated on the annular part 100 of the second contact 98. An uppermost part of the second contact spring 112 nearest to the annular member 54 is in contact with a ring member 114. In one example, the ring member 114 can be a metal washer having a sufficient surface area to seat the uppermost part of the second contact spring 112 when the spring is biased against the ring member.

A third contact 116 having an annular part 118 and arm 120 is provided at least partially within the annular member 54. The arm 120 extends downwardly toward the funnel housing 58 and is in electrical contact with the ring member 114. The annular part 118 is in electric contact with the first contact spring 84. Accordingly, when the vacuum device 20 is assembled, which results in both the first contact spring 84 and second contact spring 112 being compressed, then there is an unbroken electrical connection from the planar portion 108 of the arm 102 of the second contact 98 to the lead line 76 and one terminal of the battery 40.

The nozzle assembly 50 further includes an insulating sleeve 122 configured to electrically isolate the third contact 116 and ring member 114 from the annular member 54. FIG. 6B further illustrates the insulating sleeve attachment to the annular member 54 and tube member 64 of the nozzle assembly 50 of FIG. 6A.

The insulating sleeve 122 has a lower portion 123 that includes an outer annular rim 124 engaging the annular member 54 and a central cavity 125 configured to receive the tube member 64. The insulating sleeve 122 also includes the male threaded portion 52 for securing the insulating sleeve to the motor in fan blade assembly 32. The tube member 64 can be secured in a variety of ways to the insulating sleeve 122, including a friction fit or latch and lock mechanism. Moreover, since the inside of the tube member 64 is hollow, the hollow space within the tube member defines a second air channel 126 which is in fluid communication with the first air channel 72.

Preferably, the insulating sleeve 122 is secured to a portion of the annular member 54 and fixes the location of the tube member 64 so that a rim 66 of the tube member abuts against the stem part 62 of the funnel housing 58 when the funnel housing is furthest from the annular member (i.e., is in an open position). The insulating sleeve 122 also may extend through the annular member 54 so as to prevent any electrical contact between the ring member 114 and annular member 54.

For purposes of this application, an open position is when there is an electrical short (e.g., an air gap) between the planar portion 108 of the second contact 98 and an inner surface 128 of the annular member 54. A closed position is when there is an electrical connection between the planar portion 108 and the annular member 54, which energizes the motor 68 and causes rotation of the fan blade 70 since the electrical circuit to the battery terminals is closed. Generally, due to the biasing forces applied by the first contact spring 84 and second contact spring 112, the typical position of the device 20 absent a user applying an external force to the device will be in an open position with the distance between the annular member 54 and planar portion 108 being at a maximum.

Upon assembly of the vacuum device 20, the nozzle assembly 50 is attached to the motor and fan blade assembly 32 by connecting the male threaded portion 52 of the insulating sleeve 122 to the female threads 36. Since the first contact spring 84 and second contact spring 112 are compressed, this arrangement causes the funnel housing 58 to be in the open position with the spacing between the annular member 54 and planar portion 108 at a maximum. The spring constants of the first and second contact springs 84, 112 are selected so that a user can overcome their biasing forces and move the funnel housing 58 upward along arrow 110 to the closed position and operate the device 20.

In operation, a user manually places the open part 26 of the flexible package 22 containing a perishable food item around the stem part 62 of the nozzle assembly 50. The nozzle assembly 50 is in an open position while the user secures the flexible package 22 about the stem part 62. The user manually secures the open part 26 against an outer surface 130 of the stem part 62 to prevent air in the external environment from entering into the flexible package 22 by passing between the open part 26 and the outer surface of the stem part.

Next, a user manually moves the funnel housing 58 in a direction of arrow 110 until the nozzle assembly 50 is in a closed position. A contact is made between the planar portion 108 of the second contact 98 and the annular member 54 which energizes the motor 68. The motor 68 rotates the fan blade 70, which creates an air flow from the external environment (i.e., within the flexible package 22) through the second air channel 126 and first air channel 72 before exiting the vacuum device 20 at vents 30. The user can control how much air within the flexible package 22 is vacuumed therefrom by controlling how long the vacuum device 20 remains in the closed position.

Once a majority of the air is removed from the flexible package 22 (e.g., the flexible package is shaped like the food item and snug against the item), then a user can remove the open part 26 of the flexible package and seal the package using known locking mechanisms such as zip locks, ties, etc. to prevent air from the external environment from entering the flexible package. Since the first and second contact springs 84 and 112 exert a force on the funnel housing 58, the funnel housing moves in a direction opposite to arrow 110 and into an open position upon the user removing the flexible package 22 from the conical part 62. The annular flange 66 limits the movement of the funnel housing 58 away from the annular member 54. Since air was removed using the vacuuming power of the fan blade 70, an advantage of the present invention is that an increased quantity of air may be removed from the flexible package 22 compared to conventional techniques where users manually attempt to remove air from a flexible package by applying an external force to the package.

Figure 7:
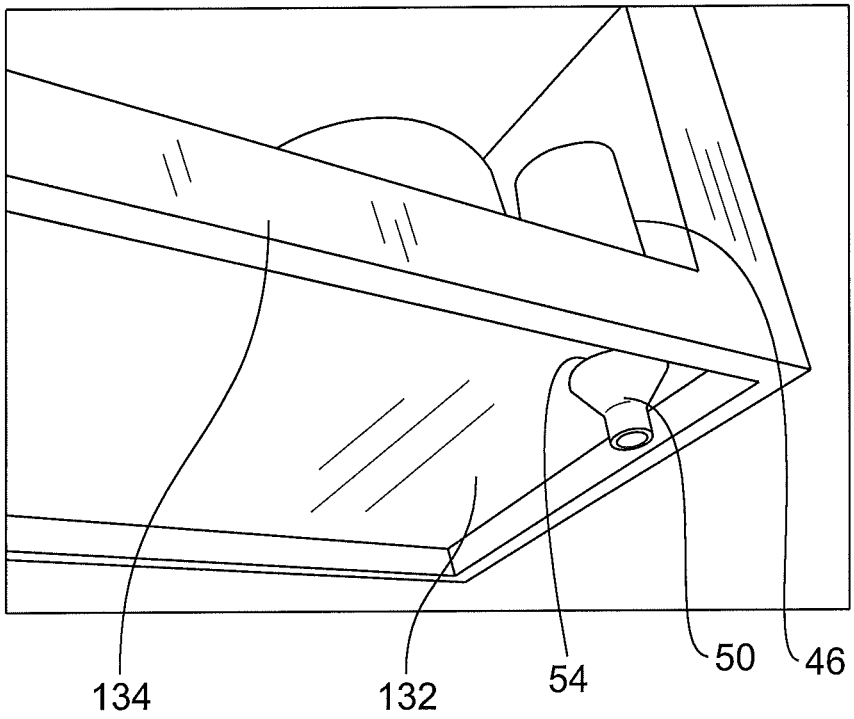
FIG. 7 is a perspective view of the vacuum device of FIG. 1 secured to a base panel of a kitchen cabinet.

FIG. 7 show a perspective view of the vacuum device 20 secured to a bottom panel 132 of a cabinet 134. A portion of the insulating sleeve 122 of the nozzle assembly 50 passes through the bottom panel 132 and connects to the lower portion of the motor and fan blade assembly 32. The annular member 54 may preferably be anchored flush against the bottom panel 132. The funnel housing 58 is located beneath (i.e., in an exterior portion) of the cabinet 134 so as to provide easy user access to the stem part 62. Since the annular member 54 is also beneath the cabinet 134, a user can readily use the vacuum device 20 without needing to open the cabinet. Moreover, since the motor and fan blade assembly 32 and power supply housing 46 are located within the cabinet 134, an advantage of this design is that noise can be reduced when the cabinet is closed. Furthermore, the location of the vacuum device 20 can vary about the bottom panel 132 of the cabinet 134.

In one embodiment, it is envisioned that the vacuum device 20 can be hidden behind a vertical cross member of the cabinet 134 that is located between adjacent cabinet doors. In other embodiments, it is envisioned that a switch (see FIG. 8) could be used to turn on and off the motor 68 and fan blade 70 instead of movement of the nozzle assembly 50 to the closed position. In another embodiment, it is envisioned that the vacuum device 20 may be formed to attach to the bottom panel 132 instead of passing through the bottom panel. The power supply housing 46 could be reconfigured to attach to the bottom panel 132. In such an embodiment, the power supply housing 46 would preferably have a secure locking mechanism to secure to the motor and fan blade assembly 32 to prevent unintended separation of these components.

Figure 8:
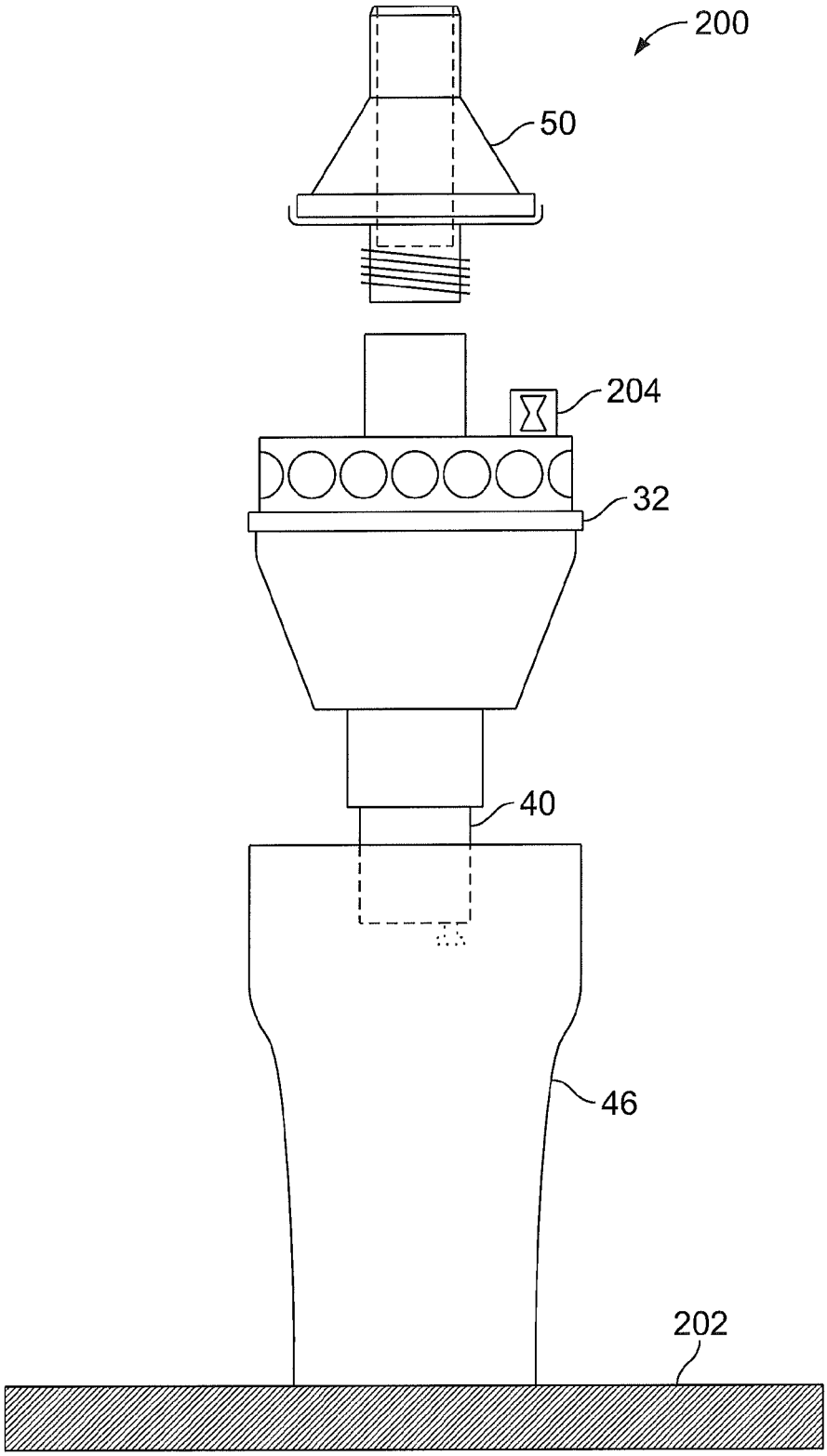
FIG. 8 is a side view of an embodiment of a stand-alone vacuum device according to the present invention.

The vacuum device can be configured as a stand-alone device 200 as shown in FIG. 8. For simplicity, similar components of the stand-alone device 200 as those of the vacuum device 20 are identified with like reference numerals. The stand-alone device 200 can be used on any generally flat surface, for example, on a kitchen countertop. The device 200 has a nozzle assembly 50, motor and fan blade assembly 32, and power supply housing 46 like the vacuum device 20. However, the power supply housing 46 may have a base 202 that provides stability for the device 200.

In one embodiment, it is envisioned that an AC power source could replace the battery 40. In this embodiment, a power cord (not shown) could be supplied through the power supply housing 46 to internal components (e.g., a transformer, transistors, etc.) to provide power to the motor 68 as is known to those skilled in the art.

Optionally, a switch 204 may also be provided to operate the motor 68 and fan blade 70. The switch 204 may be inserted between the lead lines 76 and 78 to turn the motor on or off as is known to those skilled in the art. In the illustrated embodiment, the switch 204 is attached to the housing of the device 200. However, other locations of the switch 204 may include locations that are external to the device. If a switch 204 is used, then the funnel housing 58 may be fixed relative to the annular member 54. A skilled artisan will recognize that there are many ways to fix the funnel housing 58 relative to the annular member 54. One such example is by replacing the first and second contact springs 84 and 112 in the nozzle assembly 50 with non-resilient components.

Figure 9:
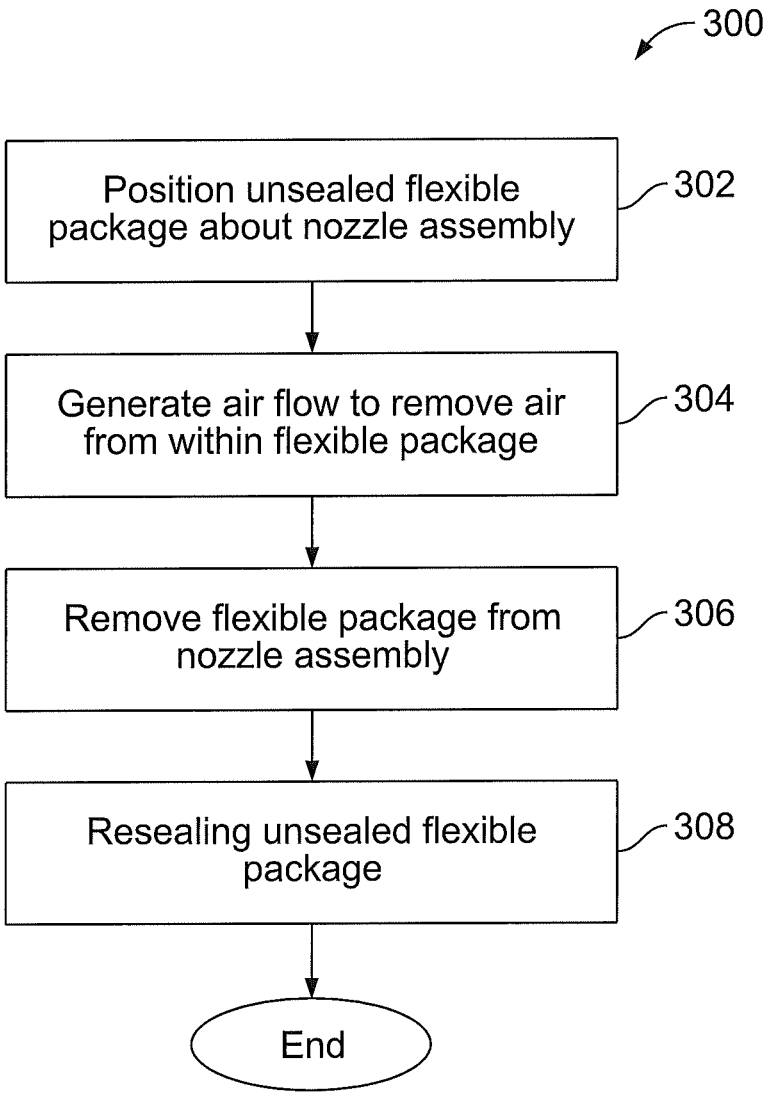
FIG. 9 is a flowchart of a method for preserving perishable consumer goods stored in a sealed flexible package that has been unsealed according to the present invention.

The present invention also provides a method 300 for preserving perishable food items stored in a sealed flexible package that has been unsealed as shown in the flowchart of FIG. 9. The method includes a step of positioning an open part of the unsealed flexible package around a first end of a nozzle assembly of a vacuum device 302. The nozzle assembly has an air passage extending from a first end to a second end of the nozzle assembly. Next, the method generates an air flow through the air passage such that substantially any air within the unsealed flexible package passes through the air passage and exits from the vacuum device into the ambient environment 304. For purposes of this invention, "substantially any air" can be at least 90% and preferably at least 98% of the air contained in the flexible package. The method also has a step of removing the unsealed flexible package from the first end of the nozzle upon a substantial portion of the air within the unsealed flexible package exiting from the unsealed flexible package 306. Additionally, the method reseals the unsealed flexible package at step 308 and then ends at 310. Upon removal of the unsealed flexible package in step 306, it is desirable to close the open part of the package as the package is disengaged from the nozzle assembly to prevent any air from entering into the flexible package before the package is sealed in step 308.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

What is claimed is:

1. A vacuum device for removal of air from a flexible package storing a perishable food item, comprising:

a motor and fan blade assembly having a first air channel;

a power supply housing enclosing at least a portion of the motor and fan blade assembly; and a nozzle assembly electrically connected to the motor and fan blade assembly and having a second air channel in fluid communication with the first air channel, wherein air in an external environment flows through the second air channel and into to the first air channel upon actuation of the nozzle assembly to a closed position by moving a portion of the nozzle assembly vertically toward the motor and fan blade assembly.

2. The vacuum device of claim 1, further comprising a power supply electrically connected to the nozzle assembly.

3. The vacuum device of claim 2, wherein the motor and fan blade assembly comprises a fan blade and motor, the motor configured to rotate the fan blade upon being energized by the power supply to cause air in an external environment to flow through the nozzle assembly and exit through the motor and fan blade assembly.

4. The vacuum device of claim 3, wherein actuation of the nozzle assembly to the closed position causes a closed electrical circuit between the power supply and the motor to rotate the fan blade.

5. The vacuum device of claim 2, wherein the nozzle assembly is configured to receive an open part of the flexible package, and upon actuation of the nozzle assembly to the closed position with the open part secured to the nozzle assembly, air within the flexible package enters the vacuum device and flows through the first and second air channels before exiting the vacuum device.

6. The vacuum device of claim 1, wherein the power supply is a battery.

7. The vacuum device of claim 1, wherein the power supply housing attaches to the motor and fan blade assembly by a friction fit.

8. The vacuum device of claim 1, wherein the nozzle assembly further comprises:

a funnel housing having a conical part and a stem part; and a tube member having an upper portion connected to the motor and fan blade assembly and a flanged lower portion stopped by the stem part upon connection of the tube member to the motor and fan blade assembly.

9. The vacuum device of claim 8, wherein the nozzle assembly further comprises:

a first contact spring;

a second contact spring biased by the first contact spring, the second contact spring encircling a portion of the tube member; and a ring member located between the first and second contact springs.

10. The vacuum device of claim 9, wherein the nozzle assembly further comprises an annular member having an aperture therethrough and located between the first and second contact springs.

11. The vacuum device of claim 10, wherein the nozzle assembly further comprises an insulating sleeve configured to electrically isolate the first contact spring from the annular member and to receive the tube member.

12. The vacuum device of claim 11, wherein the insulating sleeve further electrically isolates the ring member from the annular member.

13. The vacuum device of claim 11, wherein said insulating sleeve includes an annular rim configured to engage the annular member.

14. The vacuum device of claim 9, further comprising:

a first contact having an arm and in electrical contact with the ring member; and a second contact seated within the funnel housing and electrically connected to the ring member, the second contact having an arm extending to a rim of the conical part of the funnel housing.

15. A stand-alone vacuum device configured to remove air from within a flexible package, comprising:

a base;

a motor and fan blade assembly connected to the base and including a motor;

a fan blade connected to and rotatable by the motor;

a power supply housing having one or more air vents and surrounding at least a portion of the motor and fan blade; and a nozzle assembly connected to the motor and fan blade assembly and having an air passage in fluid communication with the one or more air vents, wherein air within the flexible package exits the flexible package and flows through the vacuum device upon an open portion of the flexible package substantially surrounding an end part of the nozzle assembly and operation of the motor by moving a portion of the nozzle assembly vertically toward the motor and fan blade assembly.

16. The stand-alone vacuum device of claim 15, further comprising a switch electrically connected to the motor and configured to energize the motor when in a closed position.

17. The stand-alone vacuum device of claim 15, wherein the switch further comprises:

a funnel housing; and a tube extending through the funnel housing, the funnel housing being reciprocally moveable upon the tube between an open position and a closed position.

18. The stand-alone vacuum device of claim 17, wherein the funnel housing is spring biased toward the open position.

19. The stand-alone vacuum device of claim 17, further comprising an annular member electrically connected to the motor, and wherein in the closed position the funnel housing is in contact with the annular member.

20. A method for preserving perishable food items stored in a sealed flexible package that has been unsealed, comprising the steps of:

positioning an open part of an unsealed flexible package around a first end of a nozzle assembly of a vacuum device having an air passage extending from the first end to a second end of the nozzle assembly;

activating the vacuum device by moving the nozzle assembly vertically in a direction away from the first end of the nozzle assembly;

generating an air flow through the air passage such that substantially any air within the unsealed flexible package passes through the air passage and exits the vacuum device into the ambient environment;

removing the unsealed flexible package from the first end of the nozzle assembly upon a substantial portion of the air within the unsealed flexible package exiting from the unsealed flexible package; and resealing the unsealed flexible package.

* * * * *